United States Patent [19]

Frind et al.

[11] 4,058,785

[45] Nov. 15, 1977

[54] CURRENT LIMITING FUSE

[75] Inventors: Gerhard Frind, Albany; Robert W. Fisk, Schenectady; Michael H. McLaughlin, Scotia, all of N.Y.

[73] Assignee: General Electric Company, Schenectady, N.Y.

[21] Appl. No.: 725,380

[22] Filed: Sept. 22, 1976

[51] Int. Cl.[2] ..... H01H 85/02

[52] U.S. Cl. ..... 337/204; 337/277

[58] Field of Search ..... 337/204, 276, 277, 279, 337/282

[56] References Cited

U.S. PATENT DOCUMENTS

| | | | |
|---|---|---|---|
| 3,710,295 | 1/1973 | Staub et al. | 337/204 X |
| 3,771,089 | 11/1973 | Link | 337/204 X |
| 3,800,262 | 3/1974 | Cinquin | 337/276 X |
| 3,818,409 | 6/1974 | Pastors et al. | 337/204 X |
| 3,851,290 | 11/1974 | Stover et al. | 337/204 X |

*Primary Examiner*—George Harris

*Attorney, Agent, or Firm*—Paul R. Webb, II; Joseph T. Cohen; Jerome C. Squillaro

[57] ABSTRACT

A current limiting fuse is disclosed wherein at least one fuse element is employed and each such fuse element is positioned in a narrow space filled with dielectric fluid adjacent a rigid electrically insulating member with a plurality of rupturable vents and a chamber on the opposite side of the member. The narrow space filled with dielectric fluid defines the arc constrictor while the chamber on the side of the member defines the plasma cooler space.

12 Claims, 6 Drawing Figures

CURRENT LIMITING FUSE

The present invenion relates in general to fuses and more particularly to fuses which will carry high normal currents and yet will provide rapid circuit interruption for undesirably high currents of short duration.

Such large current, high speed fuses are presently available for the protection of devices such as high current carrying semiconductor control devices. Such prior art fuses include fusible elements such as small wires or ribbon, enclosed in a housing containing a gas. The fusible elements are usually embedded in a solid-granular material such as sand or ceramic. While such fuses will melt and interrupt a circuit when large currents of short duration, for example several milliseconds, are passed therethrough, at lower currents of longer time duration excessive element temperature cycling usually results in failure at less than the design failure value.

In U.S. Pat. No. 3,710,295, a current limiting fuse is described wherein at least one fusible conductive element is connected between a pair of electrodes. Portions of the electrodes and the element are positioned within a housing filled with a dielectric fluid. This patent is assigned to the same assignee as the present application.

In U.S. Pat. No. 3,851,290, a fuse is described wherein the length of the fuse is supported by a link holder within a housing filled with dielectric fluid.

The present invention is directed to an improved current limiting fuse wherein at least one fuse element is employed, and each such fuse element is positioned in a narrow space filled with dielectric fluid adjacent a rigid electrically insulating member with a plurality of rupturable vents and a chamber on the opposite side of the member.

It is an object of the present invention to provide a fuse with high normal current capacity yet which provides rapid circuit interruption for undesirably high currents of short time duration.

It is another object of the present invention to provide a current limiting fuse of large current carrying capacity yet which is more rapid in response to overload currents.

It is a further object of the present invention to provide a fuse of smaller size than conventional fuses for a given current rating.

In accordance with one aspect of our invention, a current limiting device employs at least one fuse element, and each such fuse element is positioned in a narrow space filled with dielectric fluid adjacent a rigid electrically insulating member with a plurality of rupturable vents and a chamber on the opposite side of the member.

These and various other objects, features and advantages of the invention will be better understood from the following description taken in connection with the accompanying drawing in which.

Figure 1:
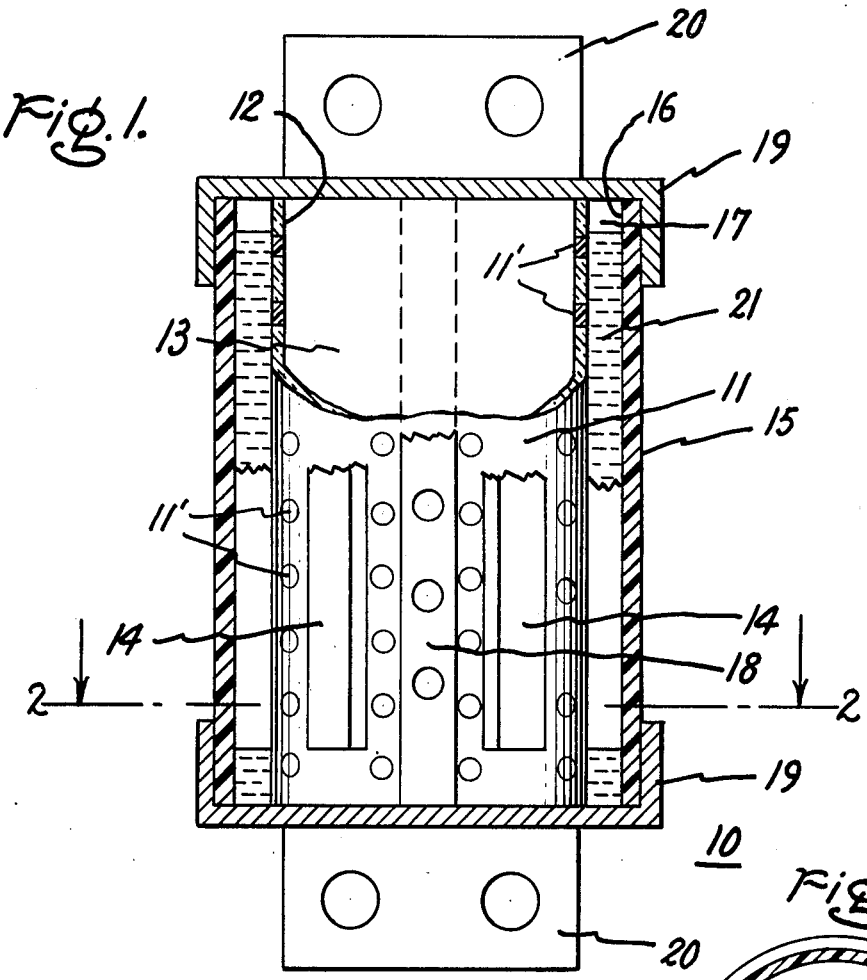
FIG. 1 is a partial sectional view of a current limiting fuse made in accordance with our invention.
Figure 2:
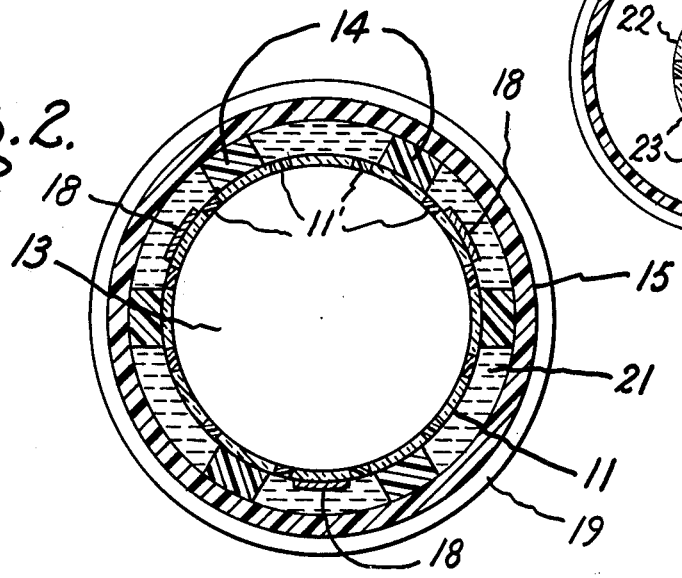
FIG. 2 is a view of the current limiting fuse of FIG. 1 taken along section line 2—2 thereof.

In FIGS. 1 and 2 of the drawing, there is shown a current limiting fuse generally at 10 which comprises a rigid electrically insulating member 11 having a plurality of rupturable vents 11' and having opposite open ends 12 forming a plasma cooler space 13. A plurality of spacers 14 extend longitudinally along the exterior surface of the membrane 11. An outer casing 15 having opposite open ends 16 surrounds member 11 and is spaced therefrom by spacers 14 on the exterior surface of member 11 to provide a narrow space 17 forming an arc constrictor. At least the interior portion of casing 15 is electrically insulating. Fuse elements 18 extend adjacent member 11 and longitudinally between member 11 and casing 15. Both member 11 and surrounding casing 15 have opposite open ends 12 and 16, respectively fitted tightly within metallic end caps 19. Casing 15 insulated electrically from at least one terminal 20. Each opposite end of fuse elements 18 are shown in electrical contact with electrical terminals 20 through associated end caps 19. Electrical terminals 20 are shown connected electrically to each of end caps 19 by being affixed thereto or integral therewith. It will be appreciated that direct electrical contact can be accomplished between each fuse element and its associated electrical terminals. For example, the fuse elements can contact directly at each opposite end the respective electrical terminal. Such a configuration can include a pair of metallic end caps, each of which has a center opening. An electrical terminal has its base positioned within the opening in the end cap. An electrically insulating ring positions the base of the electrical terminal within the opening of the end ring and bonds the structure thereby providing a closed end for the fuse. A dielectric liquid 21 fills substantially space 17 between member 11 and casing 15.

Figure 3:
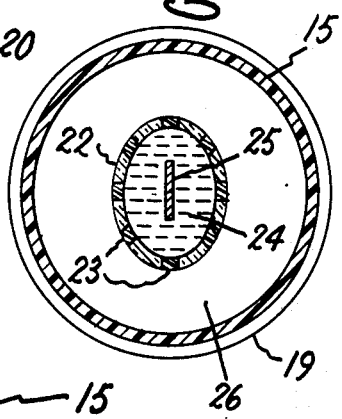
FIG. 3 is a sectional view through a modified current limiting fuse.

In FIG. 3 of the drawing, there is shown a modified current limiting fuse which comprises a rigid, electrically insulating member 22 having a plurality of rupturable vents 23 defining a narrow space filled with dielectric fluid 24 forming an arc constrictor. A fuse element 25 is immersed in fluid 24 and extends longitudinally along member 22. Member 22 has opposite open ends. An outer casing 15 having opposite open ends surrounds member 22 and is spaced therefrom defining a plasma cooler space 26. At least the interior portion of casing 15 is electrically insulating. Both member 22 and surrounding casing 15 have opposite open ends fitted tightly within metallic end caps 19. Casing 15 is insulated electrically from at least one terminal 20. Each opposite end of fuse element 25 is shown in electrical contact with an electrical terminal 20 through an associated end cap 19. Electrical terminal 20 is shown connected electrically to each of end caps 19 by being affixed thereto or integral therewith. It will be appreciate that direct electrical contact can be accomplished between each fuse element and its associated electrical terminals. For example, the fuse element can contact directly at each opposite end the respective electrical terminal. Such a configuration can include a pair of metallic end caps, each of which has a center opening. An electrical terminal has its base positioned within the opening in the end cap. An electrically insulating ring positions the base of the electrical terminal within the opening of the end ring and bonds the structure thereby providing a closed end for the fuse.

Figure 4:
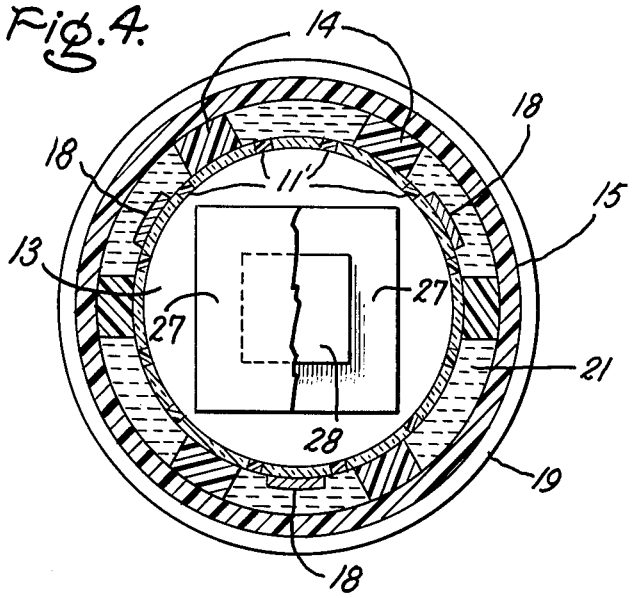
FIG. 4 is a sectional view through another modified current limiting fuse.

In FIG. 4 of the drawing, there is shown a modified current limiting fuse similar to fuse 10 in FIGS. 1 and 2 of the drawing. Similar numbers are used to identify corresponding parts from FIGS. 1 and 2. In this modified fuse, there are shown electrically insulating plates 27 in plasma cooler space 13 within member 11. An electrically insulating spacer 28 is shown positioned between plates 27.

Figure 5:
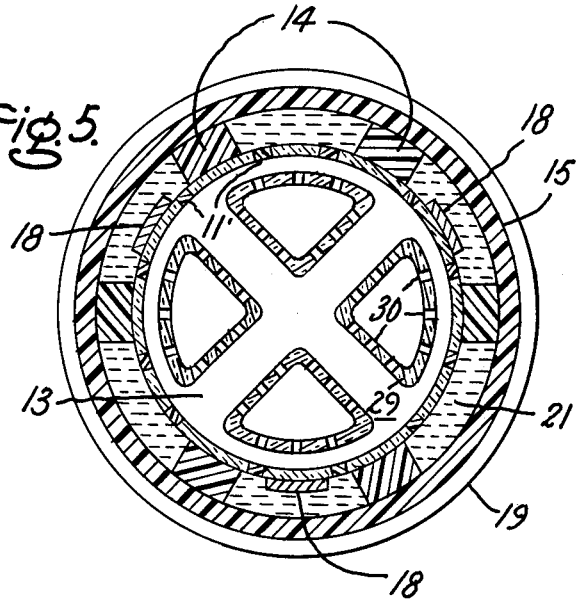
FIG. 5 is a sectional view through a further modified current limiting fuse.

In FIG. 5 of the drawing, there is shown a modified current limiting fuse similar to fuse 10 in FIGS. 1 and 2 of the drawing. In this modified fuse, there are shown a plurality of hollow, spaced apart casings 29 which are positioned in plasma cooler space 13 within member 11. Each casing 29 has a major number of small holes 30 in its wall. For sake of clarity, only a representative number of holes 30 are shown.

Figure 6:
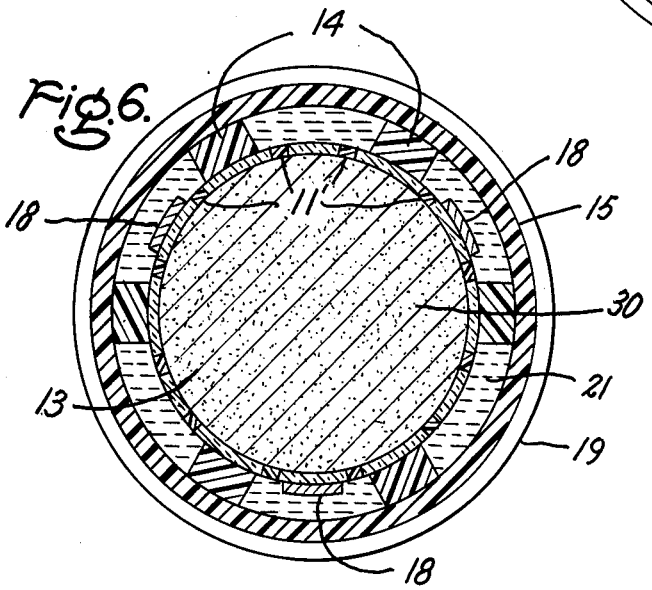
FIG. 6 is a sectional view through a still further modified current limiting fuse.

In FIG. 6 of the drawing, there is shown a modified current limiting fuse similar to fuse 10 in FIGS. 1 and 2 of the drawing. In this modified fuse, granular material 30 fills cooler space 13 within member 11.

In carrying out the invention, and as applied particularly to the embodiments shown in the drawing and described above, a first predetermined current flow in the fuse elements produces a first predetermined thermal power flow into the liquid which is sufficient to produce nucleate boiling of the liquid. A second greater predetermined current flow in the fuse elements produces a second predetermine thermal power flow into the liquid which is sufficient to produce vapor film boiling in the liquid. Since the heat transfer coefficient for the nucleate boiling regime is substantially greater than the heat transfer coefficient for the vapor film boiling regime, thermal energy accumulates in the fuse elements at a rapid rate and raises the temperature at a rapid rate. The fuses elements are constituted of a material and designed so that the second predetermined current raises the temperature thereof above the melting point of the elements. In view of the low thermal mass of the fuse elements, such temperature rise is rapid. Accordingly, the elements melt and rapidly interrupt the current of the second predetermined value flowing through the fuse.

We found that we could form an improved current limiting fuse which will function in either vertical or horizontal positions by providing at least one rigid, electrically insulating member having a plurality of rupturable vents defining a narrow space forming an arc constrictor and having opposite open ends. A dielectric liquid fills substantially the narow space. At least one fuse element is employed. Each fuse element is immersed in the dielectric fluid and extends longitudinally adjacent the member. An outer casing has opposite open ends surrounding the member and is spaced therefrom. At least the interior portion of the casing is electrically insulating. Both the member and the casing have opposite open ends fitted tightly within metallic end caps while the casing is insulated electrically from at least one of the electrical terminals. Each opposite end of the fuse element is in electrical contact with an electrical terminal. When the fuse element is in direct electrical contact with its associated end cap, an electrical terminal is connected electrically to each of the end caps.

The member is suitably formed of a plastic or ceramic material while the outer casing is suitably formed of fiberglass or a high strength plastic. A metal casing can also be employed but its inner surface must be electrically insulating and the casing must be electrically insulated from at least one of the end caps. The rupturable vents of the member should rupture between 5 to 10 atmospheres of pressure. Such rupturable vents include a variety of configurations such as vents in a ceramic membrane covered with a plastic membrane or thinner portions in the member to provide the vents. The narrow space forming the arc constrictor is preferably in the range of 50 to 250 mil. A dielectric fluid is contained within the narrow space. We found that the electrical arc, which is generated after the fuse element vaporizes is well confined within such narrow space and exhibits high voltage gradients of the order of 200 volts per centimeter. The arc voltage shows, on account of the good arc control, only moderate fluctuations.

Cold start-up rating is a requirement affecting design of the current limiting fuse. Since the maximum nucleate boiling heat flux declines with decreasing temperature of the fluid within the temperature range of interest, it is desirable to minimize fuse derating. This can be accomplished by the addition of an inert, non-condensable gas, such as nitrogen to the dielectric fluid.

As it is shown in FIGS. 1 and 2 of the drawing and described above, the plasma cooler space is defined by the interior chamber of the member which is employed for cooling purposes. The plasma cooler space has a similar function to the sand in the sand fuse. It cools the plasma emanating from the fuse element and limits the resulting internal pressure to a manageable level. Other modifications of the plasma cooler space are suitable for incorporation in our current limiting fuse. For example, a plurality of electrically insulating flat plates with spacers therebetween are spaced within the member. Hollow, spaced apart casings can also be positioned within the members, each of which inner casings has a major number of small holes in its wall. The plasma cooler space can also be modified wherein this space within the member is filled with granular material. The plasma cooler space is sealed tight against the arcing anulus, which is filled with the dielectric liquid. The member provides this sealing for the plasma cooler space. This member has to seal the plasma cooler space but burst easily through the rupturable vents under pressure from the arc, admitting plasma and also unevaporated liquid to the plastic cooler space. The flat plates or inner casings with holes can be made of a variety of materials, such as plastics or ceramics.

We have found further that a plurality of fuse elements can be employed, each of which extends longitudinally between the member and the casing. Further each of these fuse elements can be bonded or affixed in any suitable manner to the exterior surface of the member. Each opposite end of each of the fuse elements is in electrical contact with its associated metallic end cap. When a high current rating is desired, the number of fuse elements is increased.

In FIG. 3 of the drawing, the rigid, electrically insulating member having a plurality of rupturable vents is of the type described above for FIG. 1. However, the member defines therein a narrow space forming the arc constrictor. The dielectric fluid substantially fills the narrow space and has immersed therein a fuse element extending longitudinally adjacent the member. The member and casing define a plasma cooler space therebetween. While only one member is shown in FIG. 3, it will be appreciated that a plurality of such members can be employed. As in the description of the previous FIGS. 1 and 2, an inert, non-condensable gas can be contained in the dielectric liquid. Similarly, the fuse element can have one or more restrictions in cross-section.

The pre-arcing performance of the current limiting fuse is governed by the fuse elements which are the current carrying members. Each of these elements is designed to carry a stated steady state current and also all specified long time overloads without failure or fatigue. Secondly, the fuse elements must melt and clear under maximum available short circuit current in time to protect other equipment in the circuit. Thirdly, the shape of the interruption curve in the intermediate fault range, which is from 5 milliseconds to 1 second can be changed by element design to better match the fuse to the electric system.

The fuse element design includes both the material and the geometry of the conductor. The choice of the fuse element material, such as, for example: tin, copper or silver, determines the relative surge performance with respect to the design steady state rating for a given width of fuse element. After the fuse element material has been chosen, the steady state and surge characteristics of the current limiting fuse can be tailored to the specific application requirements by variations in width, thickness, and restriction of cross-section. The geometry of the restriction and the restriction fraction are the most important variations in the tailoring of the shape in the interruption curve. The characteristics of arcs in narrow channels determines the number of restrictions required for interruption.

The present current limiting fuse can be employed to better protect semiconductor components, such as thyristors, against damaging short circuit current. The value of the clearing $I^2t$ of the current limiting fuse must be lower than the short time $I^2t$ capability of the semiconductor component. Tests have shown that current limiting fuses of the types embodied in our present invention will have from 6 to 12 times less $I^2t$ to melt than comparably current rated sand fuses under fault conditions. This improvement provides the protection needed to use semiconductor components near the maximum steady state current capability. Presently, the inability of sand fuses to protect thyristors from short circuit faults necessitates the derating of the entire system with the use of lower current rated fuses.

In motor start applications, a current limiting fuse of the type embodied in our invention and a circuit breaker can be employed to protect the motor from harmful overloads and short circuit surges. The unacceptable overload ranges are controlled by the circuit breaker while the fuse clears all short circuit faults. As an example, a 100 amp drive with 5 times 30 second overload would require a circuit breaker to clear currents between 500 amps and 1000 amps. The fuse would be rated at least 500 amps continuous duty. Because the time to melt characteristic curve of the boiling fuse is so steep, an element can be designed to interrupt the 1000 amp current in less than 0.1 seconds. This capability leads to the use of a less expensive circuit breaker and significant cost reductions.

While other modifications of the invention and variations thereof which may be employed within the scope of the invention have not been described, the invention is intended to include such as may be embraced within the following claims:

What we claim as new and desire to secure by Letters Patent of the United States is:

1. A current limiting fuse comprising at least one rigid electrically insulating member having a plurality of rupturable vents defining a narrow space forming an arc constrictor, a dielectric liquid substantially filling the narrow space, the member having opposite open ends, at least one fuse element, each such fuse element immersed in the dielectric fluid and extending longitudinally adjacent the member, an outer casing having opposite open ends surrounding the member and spaced therefrom, at least the interior portion of the casing being electrically insulating, a pair of metallic end caps with associated electrical terminals, both the member and the casing having opposite open ends fitted tightly within the metallic end caps and associated electrical terminals, the casing insulated electrically from at least one of the electrical terminals, and each opposite end of the fuse element in electrical connection with its associated electrical terminal.

2. A current limiting fuse comprising at least one rigid electrically insulating member having a plurality of rupturable vents, the member having opposite open ends, an outer casing having opposite open ends surrounding the member and spaced therefrom, at least the interior portion of the casing being electrically insulating, the member and the outer casing defining a narrow space therebetween forming an arc constrictor, a dielectric liquid substantially filling the narrow space, at least one fuse element, each such fuse element immersed in the dielectric fluid and extending longitudinally adjacent the member, a pair of metallic end caps with associated electrical terminals, both the member and the casing having opposite open ends fitted tightly within the metallic end caps and associated electrical terminals, the casing insulated electrically from at least one of the electrical terminals, and each opposite end of the fuse element in electrical connection with its associated electrical terminal.

3. A current limiting fuse as in claim 2, in which the fuse element is affixed to the exterior surface of the member.

4. A current limiting fuse as in claim 2, in which a plurality of spaced apart fuse elements are affixed to the exterior surface of the member, and each fuse element extends longitudinally along the member.

5. A current limiting fuse as in claim 2, in which a plurality of electrically insulating flat plates with spacers therebetween are positioned within the member.

6. A current limiting fuse as in claim 2, in which a plurality of hollow, spaced apart casings are positioned within the member and, each casing has a major number of small holes in its wall.

7. A current limiting fuse as in claim 2, in which granular material fills the interior of the member.

8. A current limiting fuse as in claim 2, in which the fuse element has at least one restriction in cross-section.

9. A current limiting fuse as in claim 2, in which an inert, non-condensable gas is contained in the dielectric liquid.

10. A current limiting fuse comprising at least one rigid electrically insulating member having a plurality of rupturable vents defining a narrow space therein forming an arc constrictor, a dielectric liquid substantially filling the narrow space, the member having opposite open ends, at least one fuse element, each such fuse element immersed in the dielectric fluid and extending longitudinally adjacent the member, an outer casing having opposite open ends surrounding the member and spaced therefrom, defining a plasma cooler space, at least the interior portion of the casing being electrically insulating, a pair of metallic end caps with associated electrical terminals, both the member and the casing having opposite open ends fitted tightly within the metallic end caps and associated electrical terminals, the casing insulated electrically from at least one of the electrical terminals, and each opposite end of the fuse element in electrical connection with its associated electrical terminal.

11. A current limiting fuse as in claim 10, in which the fuse element has at least one restriction in cross-section.

12. A current limiting fuse as in claim 10, in which an inert, non-condensable gas is contained in the dielectric liquid.

* * * * *